US009197036B2

(12) United States Patent
Sumoyama et al.

(10) Patent No.: US 9,197,036 B2
(45) Date of Patent: Nov. 24, 2015

(54) SPARK PLUG

(71) Applicant: NGK SPARK PLUG CO., LTD., Nagoya-shi, Aichi (JP)

(72) Inventors: Daisuke Sumoyama, Nagoya (JP); Tomonori Kanemaru, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 214 days.

(21) Appl. No.: 14/045,998

(22) Filed: Oct. 4, 2013

(65) Prior Publication Data

US 2014/0097739 A1 Apr. 10, 2014

(30) Foreign Application Priority Data

Oct. 5, 2012 (JP) ..... 2012-222741

(51) Int. Cl.
*H01T 13/20* (2006.01)
*H01T 13/39* (2006.01)

(52) U.S. Cl.
CPC ..... *H01T 13/20* (2013.01); *H01T 13/39* (2013.01)

(58) Field of Classification Search
CPC ..... H01T 13/20; H01T 13/39
See application file for complete search history.

(56) References Cited

U.S. PATENT DOCUMENTS 4,488,081 A * 12/1984 Kondo et al. ..... 313/141
4,670,684 A * 6/1987 Kagawa et al. ..... 313/141
5,998,913 A 12/1999 Matsutani
6,046,532 A 4/2000 Matsutani et al.
2006/0043855 A1 3/2006 Nunome et al.
2006/0061250 A1 3/2006 Yoshimoto et al.
2009/0302732 A1* 12/2009 Lykowski ..... 313/141
2012/0187820 A1 7/2012 Mitsuda et al.
2014/0159564 A1* 6/2014 Sumoyama et al. ..... 313/141

FOREIGN PATENT DOCUMENTS

CN 1698244 A 11/2005
CN 1698245 A 11/2005
CN 102593721 A 7/2012
JP 09-007733 A 1/1997
JP 11-154583 A 6/1999
JP 3672718 B2 7/2005
JP 2009-87894 A 4/2009
JP 2009-187954 A 8/2009
JP 4402046 B2 11/2009
JP 2010-218778 A 9/2010

OTHER PUBLICATIONS

Communication dated Jun. 30, 2015 issued by the State Intellectual Property Office of P.R. China in counterpart Chinese Patent Application No. 201310464799.5.

* cited by examiner

*Primary Examiner* — Nimeshkumar Patel
*Assistant Examiner* — Jacob R Stern
(74) *Attorney, Agent, or Firm* — Sughrue Mion, PLLC

(57) ABSTRACT

In a spark plug, at least either of a center electrode and a ground electrode has a tip which defines a gap, a tip provided on at least either of a center electrode and a ground electrode contains Ir, Rh and Ru in a total amount of 95 mass % or more with respect to the whole mass amount thereof, and the contents (Rh, Ru) of Rh and Ru (mass %) lie within an area which is surrounded by a line which connects point A (6, 1), point B (6, 15), point C (33, 18), point D (33, 4) and the point A (6, 1) in this order or lie on the line. The tip satisfies 1.5≤Has/Han≤2.2.

4 Claims, 3 Drawing Sheets

SPARK PLUG

This application claims priority from Japanese Patent Application No. 2012-222741 filed on Oct. 5, 2012, the entire-subject matter of which is incorporated herein by reference.

BACKGROUND

1. Technical Field

The present invention relates to a spark plug, and more particularly, to a spark plug in which a tip is provided on at least either of a center electrode and a ground electrode.

2. Related Art

A spark plugs used to introduce the ignition energy into a combustion chamber of an internal combustion engine as of a motor vehicle generally includes a cylindrical metal shell, a cylindrical insulator which is disposed in an internal hole of the metal shell, a center electrode which is disposed in an internal hole at a front end side of the insulator, and a ground electrode which is joined to a front end side of the metal shell at one end and which defines a spark discharge gap at the other end between the center electrode and itself. Then, in the spark plug, an ignition spark is discharged in the spark discharge gap defined between a front end portion of the center electrode and a distal end portion of the ground electrode within the combustion chamber to ignite an air-fuel mixture filling the combustion chamber for burning.

An Ni alloy is generally used as a material for forming a center electrode and a ground electrode. Although the Ni alloy is slightly inferior with respect to oxidation resistance and wear resistance to a noble metal alloy which contains a noble metal such as Pt and Ir as a main composition, the Ni alloy is inexpensive compared with the noble metal and is therefore used preferably as the material for forming the central electrode and the ground electrode.

In recent years, in order to achieve high outputs and to enhance the fuel economy of engines, there is a tendency to increase the temperature in combustion chambers. In addition, there have now been used an engine in which a discharge portion which forms a spark discharge gap protrudes into an interior of a combustion chamber so as to improve the ignition performance thereof. In these situations, the discharge portion of the spark plug are exposed to high temperatures, which tends to promote the facilitation of oxidation wear of a center electrode and a ground electrode which define the discharge portion. Then, there have been developed methods for suppressing the oxidation wear of the center electrode and the ground electrode by providing tips individually on a front end portion of the center electrode and a distal end portion of the ground electrode which face each other and causing a spark discharge to occur at the tips.

For example, JP-A-9-7733 describes therein an "internal combustion engine spark plug . . . a noble metal tip is joined to a discharging location of a front end portion of the center electrode and/or a distal end portion of the ground electrode, wherein the noble metal tip is made of an Ir—Rh alloy with a quantity of Rh added ranging from 1 wt % to 60 wt %" (refer to claim 1 of JP-A-9-7733). It is disclosed that in the noble metal tip of the internal combustion engine spark plug, the wear resistance is improved by Ir having a high melting point, and the volatilization and wear of Ir at high temperatures are prevented by adding Rh to Ir (refer to paragraph 0022 in JP-A-9-7733).

Japanese Patent No. 4402046 describes therein a "spark plug . . . the noble metal member contains Ir as a main composition, 6.5 mass % or more and 43 mass % or less of Rh, 5.2 mass % or more and 41 mass % or less of Ru and 0.4 mass % or more and 19 mass % or less of Ni" (refer to claim 1 of Japanese Patent No. 4402046). Then, Japanese Patent No. 4402046 discloses the following facts about the noble metal member of the spark plug (refer to paragraphs 0011 and 0012 of Japanese Patent No. 4402046). Since Ir having a high melting point is contained as the main composition, the good heat resistance is exhibited. Since the predetermined quantity of Rh is added, the volatilization and wear of Ir can be suppressed even at high temperatures. Since the predetermined quantity of Ni is added, an abnormal scooped wear which is generated from time to time in noble metal members depending on service conditions can be suppressed. Since the predetermined quantity of Ru is added, the wear of the noble metal member and the occurrence of a sweat-out phenomenon in which particulate matters adhere to the noble metal member can be suppressed. Additionally, the Ru addition can suppress further the occurrence of a separating phenomenon which results from the progression of the sweat-out phenomenon.

JP-A-11-154583 aims at providing a spark plug in which wear triggered by oxidation and volatilization of an Ir composition is made difficult to occur, thereby exhibiting superior durability (refer to paragraph 0004 in JP-A-11-154583). JP-A-11-154583 describes a spark plug wherein a firing portion which defines a spark discharge gap is made mainly of Ir, an area where the Vickers hardness becomes 400 Hv or less is formed to a depth or thickness of 0.05 mm from a surface of the firing portion, and a mean value of dmin/dmax which is a ratio of a minimum diameter dmin to a maximum diameter dmax of particles appearing on a section when a sectional structure of the area is observed is 0.7 or more (refer to Claim 1 and 2 of JP-A-11-154583). In a tip produced by plastically forming a metallic material made mainly of Ir through rolling, cutting, punching and the like, strain remains in the metallic material to some extent and is hence hardened as a result of the plastic forming. The hardness is increased relatively high particularly in a surface layer portion area where the strain remains to a large extent. In the event that a firing portion is formed by using the tip formed in the above-described way, wear triggered by oxidation and volatilization of the Ir composition is progressed easily. Then, it is disclosed in JP-A-11-154583 that the tip is annealed at 900 to 1700° C. to be softened so that a surface layer portion area having a predetermined thickness is formed where the Vickers hardness becomes 400 Hv or less, whereby the oxidation and volatilization of the Ir composition are suppressed effectively (refer to paragraphs 0008 to 0010 in JP-A-11-154583). In addition, particles in the tip metallic material which is subjected to the plastic forming and is hence hardened are largely stretched in the forming direction, and the dmin/dmax shows a quite small value. However, it is also disclosed that when the tip metallic material is annealed in the above-described way, recrystallization is progressed, and the dmin/dmax is gradually increased, whereby the oxidation and volatilization of the Ir composition in the firing portion are suppressed further effectively (refer to paragraph 0012 in JP-A-11-154583).

JP-A-2010-218778 describes an internal combustion engine plug electrode material having a pillar-like crystal which extends over the length of a tip and in which a hardening rate [(hardness in Hv after forming)/(hardness in Hv after heat treatment at 1100° C. for 20 hours which simulates plug service conditions)×100 (%)] which is a ratio of a hardness after forming to a hardness after the heat treatment at 1100° C. for 20 hours which simulates plug service conditions is 130% or less (refer to Claims 1 and 2 in JP-A-2010-218778). As an internal combustion engine plug electrode material in which the suppression effect of high temperature oxidation wear is improved, it is described that "it is necessary that crystalline grains are bulky and have an elongated shape and that no forming strain remains therein so that the recrystallization does not progress therein under its service temperature conditions." (refer to paragraph 0011 in JP-A-2010-218778).

SUMMARY

Incidentally, in recent years, due to the increasing application of turbocharged engines and the demand for better fuel economies, further improvements on ignition performance have been in demand. In order to meet this demand, the application of ignition coils producing large energy is spreading. Thus, it is getting important to suppress not only the oxidation wear of a spark plug under high-temperature conditions but also the oxidation wear and spark wear of a tip of a spark plug which is used under high spark-energy conditions.

Therefore, illustrative aspects of the invention provide a spark plug having a tip provided on at least either of a center electrode and a ground electrode, wherein superior durability is provided by suppressing the oxidation wear and spark wear of a spark discharge surface of the tip.

The illustrative aspects of the invention provide the following arrangements:

(1) A spark plug comprising:

an insulator that has an axial hole extending in a direction of an axial line;

a center electrode disposed at a front end side of the axial hole;

a metal terminal disposed at a rear end side of the axial hole;

a connecting portion which is electrically connected to the center electrode and the metal terminal within the axial hole;

a metal shell accommodating the insulator therein; and a ground electrode, a first end portion of which is joined to a front end portion of the metal shell, and a second end portion of which is disposed apart from the center electrode so as to define a gap therebetween, wherein at least either of the center electrode and the ground electrode has a tip which defines the gap, wherein the tip contains Ir, Rh and Ru in a total amount of 95 mass % or more with respect to the whole mass amount thereof, and the contents (Rh, Ru) of Rh and Ru (mass %) lie within an area that is surrounded by a line connecting point A (6, 1), point B (6, 15), point C (33, 18), point D (33, 4) and the point A (6, 1) in this order or lie on the line, wherein the tip satisfies a relation of 1.5 Has/Han 2.2, wherein Has is a Vickers hardness measured at a cut surface of the tip which results when the tip is cut along a plane which includes the axial line, and Han is a Vickers hardness measured at the cut surface after the tip is placed in a furnace of an Ar atmosphere to be heated and held at 1300° C. for 10 hours and is then cooled down, and wherein the tip is cooled down by stopping the heating of the tip with Ar caused to flow at a rate of 2 liter/min and keeping Ar flowing into the furnace at the same rate even after the heating of the tip has been stopped.

(2) The spark plug according to (1), wherein the contents (Rh, Ru) of Rh and Ru (mass %) lie within an area which is surrounded by a line which connects point E (11,4), point F (11, 14), point G (31, 16), point H (31, 6) and the point E (11, 4) in this order or lie on the line.

(3) The spark plug according to (1), wherein the contents (Rh, Ru) of Rh and Ru (mass %) lie within an area which is surrounded by a line which connects point I (15, 7), point J (15, 13), point K (27, 14), point L (27, 8) and the point I (15, 7) in this order or lie on the line.

(4) The spark plug according to any one of (1) to (3), wherein the center electrode has a rear end portion which is in contact with the connecting portion and a rod-shaped portion which extends from the rear end portion towards a front end side, wherein in portions of the rod-shaped portion having the same diameter, a diameter of a body portion having the longest length in the direction of the axial line is not more than 2.25 mm, and wherein a length in the direction of the axial line of an area where a distance between the rod-shaped portion and the metal shell in a direction orthogonal to the axial line is 3mm or less is not less than 9 mm.

According to the illustrative aspects of the invention, the tip contains Ir, Rh and Ru in the specific ratio, and the hardness ratio (Has/Han) lies within the specific range. Therefore, the oxidation wear and spark wear of the spark charged surface of the tip can be suppressed, whereby it is possible to provide the spark plug which has the durability.

If the diameter d of the center electrode is small, the heat generated by spark discharge is hardly transmitted from the tip to the center electrode and the insulator, so that the tip may be heated to the high temperatures and thus the tip may become easy to wear through not only oxidation wear but also spark wear. In addition, if the length H in the direction of the axial line of the area where the distance h between the center electrode and the metal shell is small is large, the quantity of electric charge stored in the center electrode may be increased, which may increase the capacitive discharge energy, whereby the tip may become easy to wear through not only oxidation wear but also spark wear. In a case where the tip of the invention is provided in a spark plug having a severe structure with respect to oxidation resistance and spark wear resistance, in which the diameter d is not more than 2.25 mm and the length H in the direction of the axial line of the area where the distance h is 3 mm or less is not less than 9 mm, the effect of suppressing the oxidation wear and spark wear near the discharge portion can be enhanced.

DETAILED DESCRIPTION

A spark plug according to the invention includes: a center electrode which is disposed in an axial hole at a front end side; a metal terminal which is disposed in the axial hole at a rear end side thereof; a connecting portion which is electrically connected to the center electrode and the metal terminal within the axial hole; a metal shell which accommodates an insulator; and a ground electrode which is joined to a front end portion of the metal shell at one end and which is disposed so as to be apart from the center electrode at the other end thereof with a gap defined therebetween. The spark plug according to the invention is not limited in any other ways as long as it has the above-described configuration and hence can adopt various known configurations.

Figure 1:
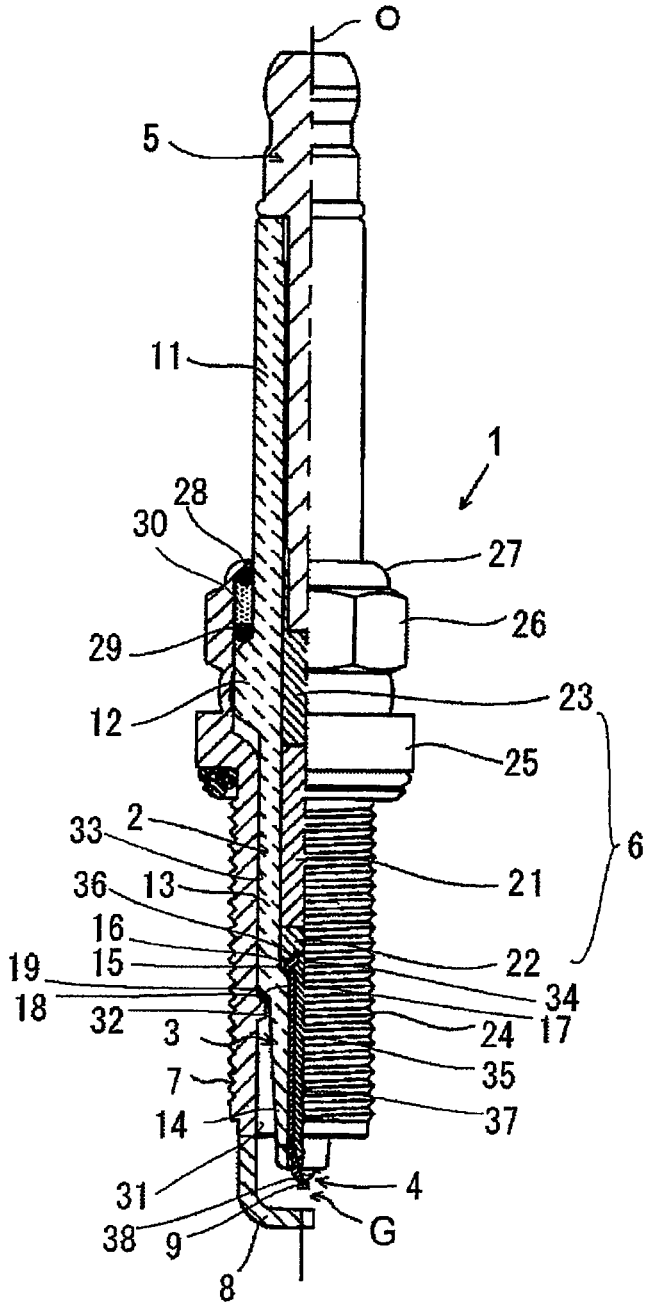
FIG. 1 is a partially sectional whole view illustrating a spark plug which configures an embodiment of a spark plug according to the invention.
Figure 2:
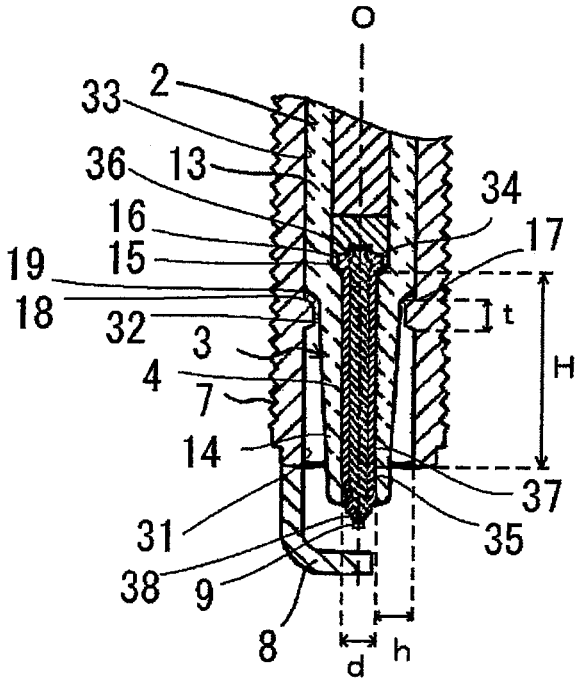
FIG. 2 is a sectional view illustrating a main part of the spark plug shown in FIG. 1.

A spark plug which configures an embodiment of a spark plug according to the invention is shown in FIGS. 1 and 2. FIG. 1 is a partially sectional whole view illustrating the spark plug 1 which configures the embodiment of the spark plug according to the invention. FIG. 2 is a sectional view illustrating a main part of the spark plug shown in FIG. 1. Incidentally, in FIGS. 1 and 2, with respect to surfaces of sheets of paper on which the figures are drawn, a downward direction represents a front end direction of an axial line O, whereas an upward direction represents a rear end direction of the axial line O.

As shown in FIGS. 1 and 2, the spark plug 1 includes: a substantially cylindrical insulator 3 which has an axial hole 2 extending in the direction of the axial line O; a substantially rod-shaped center electrode 4 which is disposed within the axial hole 2 at a front end side; a metal terminal 5 which is disposed in the axial hole 2 at a rear end side thereof; a connecting portion 6 which connects electrically the center electrode 4 and the metal terminal 5 within the axial hole 2; a substantially cylindrical metal shell 7 which holds the insulator 3; and a ground electrode 8 which is joined to a front end portion of the metal shell 7 at one end portion and which is disposed so as to face the center electrode 4 via a gap G at the other end portion. A tip 9 is provided at front end surface of the center electrode 4.

The insulator 3 has a substantially cylindrical shape. The insulator 3 includes: a rear end-side body portion 11 which accommodates the metal terminal 5 and which forms insulation between the metal terminal 5 and the metal shell 7; a large-diameter portion 12 which protrudes radially outwards in a further forward location than the rear end-side body portion; a front end-side body portion 13 which accommodates the connecting portion 6 at a front end side of the large-diameter portion 12 and which has an outside diameter which is smaller than the large-diameter portion 12; and a nose portion 14 which accommodates the center electrode 4 at a front end side of the front end-side body portion 13 and which has an outside diameter and a bore diameter which are smaller than the front end-side body portion 13. Inner circumferential surfaces of the front end-side body portion 13 and the nose portion 14 are connected together via a shelf portion 15. A collar portion 16, which will be described later, of the center electrode 4 is disposed so as to be brought into abutment with this shelf portion 15, whereby the center electrode 4 is fixed in place in an interior of the axial hole 2. Outer circumferential surfaces of the front end-side body portion 13 and the nose portion 14 are connected together via a step portion 17. A tapered portion 18 of the metal shell 7, which will be described later, is brought into abutment with this step portion 17 via a plate packing 19, whereby the insulator 3 is fixed to the metal shell 7. The insulator 3 is fixed to the metal shell 7 in such a state that an end portion of the insulator 3 in the direction of a front end thereof protrudes from a front end surface of the metal shell 7. It is desirable that the insulator 3 is formed from a material having mechanical strength, thermal strength and electric strength, and a ceramic sintered member which is mainly made up of alumina is raised as such a material.

In the axial hole 2 of the insulator 3, the center electrode 4 is provided at a front end side, the metal terminal 5 is provided at a rear end side, and the connecting portion 6 which fixes the center electrode 4 and the metal terminal 5 in place within the axial hole 2 are provided between the center electrode 4 and the metal terminal 5. The connecting portion 6 is made up of a resistor 21 which reduces propagation noise, a first sealer 22 which is provided between the resistor 21 and the center electrode 4, and a second sealer 23 which is provided between the resistor 21 and the metal terminal 5. The resistor 21 is formed by sintering a compound containing glass powder, non-metallic conductive powder and metallic powder, and its resistance value is normally 100 Ω or more. The first sealer 22 and second sealer 23 are formed by sintering a compound containing glass powder and metallic powder, and their resistance values are 100 mΩ or less. Although the connecting member 6 of this embodiment is formed by the resistor 21, the first sealer 22 and the second sealer 23, the connecting member 6 may be formed by at least any one of the resistor 21, the first sealer 22 and the second sealer 23.

The metal shell 7 has a substantially cylindrical shape and is formed so as to hold the insulator 3 when the insulator 3 is installed therein. A thread portion 24 is formed on an outer circumferential surface in the direction of a front end thereof, whereby the spark plug 1 is mounted in a cylinder head of an internal combustion engine, not shown, by making use of this thread portion 24. The metal shell 7 includes: a flange-shaped gas seal portion 25 at a rear end side of the thread portion 24; a tool engagement portion 26 with which a tool such as a spanner or a wrench is brought into engagement at a rear end side of the gas seal portion 25; and a crimped portion 27 at a rear end side of the tool engagement portion 26. Ring-shaped packings 28, 29 and talc 30 are disposed in an annular space defined between inner circumferential surfaces of the crimped portion 27 and the tool engagement portion 26 and an outer circumferential surface of the insulator 3, and the insulator 3 is fixed to the metal shell 7. The thread portion 24 includes: a front end-side inner circumferential surface 31 which is disposed at a front end side of an inner circumferential surface thereof so as to define a space between the nose portion 14 of the insulator 3 and itself; a projecting portion 32 which protrudes radially inwards in a further rearward location than the front end-side inner circumferential surface 31; and a rear end-side inner circumferential surface 33 which lies further rearwards towards a rear end side of the thread portion 24 than the projecting portion 32, which has a larger bore diameter than the projecting portion 32 and which is disposed so as to surround the front end-side body portion 13 of the insulator 3. The projecting portion 32 includes the tapered portion 18 which is tapered so as to increase a bore diameter of the thread portion 24 at a rear end side thereof. The tapered portion 18 is brought into abutment with the step portion 17 of the insulator 3 via the plate packing 19. A length t of the projecting portion 32 in the direction of the axial line O, that is, a distance t between a point where the projecting portion 32 starts to protrude radially inwards towards the rear end side from the distal end-side inner circumferential surface 31 in such a way as to reduce the bore diameter of the thread portion 24 and a point where the projecting portion 32 starts to protrude radially inwards towards the front end side from the rear end-side circumferential surface 33 in such a way as to reduce the bore diameter of the thread portion 24 is normally set to 1.8 to 3.0 mm. The metal shell 7 can be formed of conductive steels such as low carbon steels, for example.

The metal terminal 5 is a terminal for applying a voltage from ab outside to the center electrode 4 so as to generate a spark discharge between the center electrode 4 and the ground electrode 8 from the outside. The metal terminal 5 is inserted into the axial hole 2 to be fixed in place by the sealer 23 in such a state that part of the metal terminal 5 exposed from the rear end side of the insulator 3. A voltage is applied to the metal terminal 5 by an ignition coil (not shown). For example, a high voltage is applied to the metal terminal 5 by the ignition coil, which causes a high-voltage current to flow between the tip 9 and the ground electrode 8 to thereby produce a spark discharge of high spark energy. Normally, the spark energy is in the range from 10 to 60 mJ, and in the spark plug with the tip according to this invention, it is possible to suppress the oxidation wear and spark wear of a portion lying near the discharge portion even with high spark energy of 70 mJ or more. The metal terminal 5 can be formed of a metal material such as low carbon steels.

The center electrode 4 includes: a rear end portion 34 which is in contact with the connecting portion 6; a rod-shaped portion 35 which extends from the rear end portion 34 towards a front end side thereof; and the tip 9 which is joined to a front end surface of the rod-shaped portion 35. The rear end portion 34 includes the collar portion 16 which protrudes radially outwards and a head portion 36 which extends towards a rear end side of the center electrode 4 from the collar portion 16. The collar portion 16 is disposed so as to abut on the shelf portion 15 of the insulator 3, and the first sealer 22 is loaded between an inner circumferential surface of the axial hole 2 and an outer circumferential surface of the rear end portion 34, whereby the center electrode 4 is fixed in place in the interior of the axial hole 2 in the insulator 3 in such a state that the center electrode 4 is held insulated relative to the metal shell 7 while a front end of the center electrode 4 protruding a front end surface of the insulator 3. The rod-shaped portion 35 includes: a cylindrical body portion 37 which extends in the direction of the axial line O; and a front end portion 38 having a truncated cone shape at a front end of the body portion 37. Then, the tip 9 is joined to the front end portion 38. The rear end portion 34 and the rod-shaped portion 35 of the center electrode 4 can be formed of a known material which is used for the center electrode 4 such as an Ni alloy. The center electrode 4 may be made up of an outer layer which is formed of an Ni alloy or the like and a core portion which is formed of a material having a higher thermal conductivity than that of the Ni alloy and which is formed so as to be embedded concentrically with an axial center portion in an interior of the outer layer. As materials for forming the core portion, it is possible to raise, for example, Cu, Cu alloy, Ag, Ag alloy, pure Ni or the like.

The tip 9 is formed of a material having characteristics which will be described later and can have an appropriate shape such as a cylindrical shape, a prismatic shape or the like. The tip 9 is joined to the front end surface of the rod-shaped portion 35 by an appropriate method such as laser welding, resistance welding or the like.

The ground electrode 8 has, a substantially prismatic shape, for example. The ground electrode 8 is formed such that one end portion is joined to the front end portion of the metal shell 7 and the other end portion faces oppositely a front end portion of the center electrode 4 via a gap G while being bent into a substantially L shape halfway along the length thereof. The ground electrode 8 can be formed of the known material which is used for the ground electrode 8 such as the Ni alloy. The gap G in the spark plug 1 of this embodiment is a shortest distance between the tip 9 provided at the front end portion of the center electrode 4 and the ground electrode 8, and this gap G is normally set to 0.3 to 1.5 mm. Tips may be provided individually on both of the center electrode 4 and the ground electrode 8, and at least one of the tips is formed by a tip which is formed of a material having characteristics which will be described later, while the other tip may be formed of a known material which is used for tips. When a tip is provided at a distal end portion of the ground electrode 8, a shortest distance between oppositely facing surfaces of the tip provided on the ground electrode 8 and the tip 9 provided on the center electrode 4 configures the gap G, and a spark discharge is produced in this gap G.

Next, the tip 9 of the center electrode 4, which configures a characteristic part of the invention, will be described in detail.

As described in JP-A-11-154583 and JP-A-2010-218778, it has been considered heretofore that oxidation wear progresses easily in a tip in which strain remains to a large extent and that oxidation wear is suppressed in a particulate crystalline structure in which recrystallization progresses by annealing. In addition, it has been considered heretofore that as the melting point or thermal conductivity of a material of which a tip is formed get higher, the tip becomes more advantageous in spark wear resistance. Judging from these points, since the thermal conductivity becomes lower in a tip in which strain remains to a large extent than in a tip in which strain remains to a small extent or a tip formed of a recrystallized structure in which no strain remains, it is considered that the tip in which strain remains to a large extent is disadvantageous with respect to spark wear resistance. In addition, as the mechanism of spark wear that has been considered conventionally, spattering in which atoms are forced out of the surface of a tip and melting and volatilization of a metal in the surface of a tip are raised. Since the tip in which strain remains to a large extent is in an unstable state thermodynamically, it is considered that spattering and melting and volatilization of metal tend to progress easily therein and hence that the tip wears easily. Consequently, it is considered that the tip in which strain remains to a small extent or the tip formed of the recrystallized structure is advantageous in oxidation resistance and spark wear resistance irrespective of the composition of a material of which the tip is formed.

However, as a result of studies made by the inventors, it is found that although a spark plug having superior durability can be obtained from the tip in which strain remains to a small extent and the tip formed of the recrystallized structure as a result of those tips being superior in oxidation resistance under high temperature conditions, the tips are inferior in spark wear resistance under high spark energy conditions, and thus the spark plug formed by using the tips become inferior in durability under the high spark energy conditions.

As a result of further studies, it is found that by making the tip 9 lie within a specific composition range and have a certain constant degree of strain, even with a spark plug which is used under the high spark energy conditions, the spark wear resistance of the spark discharge surface is improved while maintaining the oxidation resistance, whereby a spark plug which is superior in durability can be provided by using the tip 9.

When a Vickers hardness measured at a cut surface of the tip 9 of the invention which results when the tip 9 is cut along a plane which includes the axial line O is referred to as Has, and when a Vickers hardness measured at the same cut surface after the tip 9 is placed in a furnace to be heated and held at 1300° C. for 10 hours while causing Ar to flow at a rate of 2 liter/min, is then cooled down naturally with Ar kept flowing at the rate of 2 liter/min even after the heating is stopped (hereinafter, referred from time to time to as a heating treatment) and is taken out of the furnace is referred to as Han, the tip 9 of the invention satisfies $1.5 \leq Has/Han \leq 2.2$.

A hardness ratio (Has/Han) which is a ratio of Has to Han represents the degree of strain which remains in the tip. A tip formed through steps which will be described later has a specific composition and a certain constant degree of strain. The tip obtained exhibits a hardness (Has) which results from a combination of a hardness which is determined according to the composition or the like of the tip and a hardness which is determined according to the degree at which strain remains. When this tip is subjected to the heating treatment, strain is removed completely, resulting in a particulate recrystallized structure. Consequently, the value of hardness (Han) of the tip after it has been subjected to the heating treatment represents a hardness which results from a combination of the hardness which is determined according to the composition or the like of the tip and a hardness which results when no strain remains. Consequently, the ratio of hardness of the tip (Has/Han) represents a ratio of the hardness (Has) of a tip which has strain to the hardness (Han) of a tip in which no strain remains and configures an index of the degree of strain which remains in the tip.

A tip whose hardness ratio (Has/Han) is within in the above-described range has a certain constant degree of strain. In the tip which has been subjected to the heating treatment, strain is removed completely as a result of the recrystallization occurring therein.

When the hardness ratio (Has/Han) is within the above-described range, even though the spark plug is used under the high spark energy conditions, strain remaining in the tip is made difficult to be removed. When a certain constant degree of strain remains in the tip, it is possible to suppress the spark wear, whereby the spark plug which is superior in durability can be provided. The reason that the spark wear can be suppressed by having a certain constant degree of strain is assumed as below. Since a very large magnitude of thermal energy is introduced into the spark discharge surface of the tip when a spark discharge occurs therein, the temperature of the spark discharge surface of the tip is locally increased high. Because of this, the tip wears as a result of oxidation of the metal and melting and volatilization of the metal under the high temperature conditions. Additionally, spattering is produced by the spark discharge, and the spark discharge surface is deformed by impact produced by the spark discharge, which causes part of a mass of metal to come off the spark discharge surface, whereby it is considered that the spark wear is accelerated. The tip in which a certain constant degree of strain remains has high strength. Namely, the tip in which a certain constant degree of strain remains has a larger yield stress than a tip in which no strain remains, and a quantity of plastic deformation of the tip which results when stress which is larger than the yield stress is applied thereto by the impact of the spark discharge becomes small. This makes it difficult for the mass of metal to come off, and hence it is considered that the spark wear is suppressed. On the other hand, the tip in which strain remains to a small extent or the tip which is formed of the recrystallized structure from which strain is removed completely has a relatively small yield stress, and hence, a quantity of plastic deformation of the tip which results when stress which is larger than the yield stress is applied thereto becomes large. Thus, it is considered from this that the mass of metal is made easy to come off.

If the hardness ratio (Has/Han) is smaller than 1.5, since the degree of strain which remains in the tip is small, the spark discharge surface of the tip is deformed by the impact of the spark discharge, which triggers the occurrence of a situation in which the metal comes off easily, resulting in inferior spark wear resistance. On the other hand, if the hardness ratio (Has/Han) is larger than 2.2, too much strain remains in the tip, which reduces the recrystallization temperature. Because of this, when the tip is used under high temperature combustion gas conditions and high spark energy conditions which the tip withstands when it is used in an actual internal combustion engine, strain is removed over a wide range by the spark discharge, and hence, as described above, the spark wear resistance becomes inferior.

Since the spark wear resistance may differ according to the melting point and thermal conductivity of the tip which are determined by the composition thereof, there may exist an ideal composition range for the tip. Nevertheless, it is insufficient only to optimize the composition range (optimize oxidation resistance and spark wear resistance). By making the tip have a certain constant degree of strain in a specific composition range, the oxidation wear and spark wear of a spark discharge surface can be suppressed, as a result of which the spark plug having superior durability can be provided.

Figure 3:
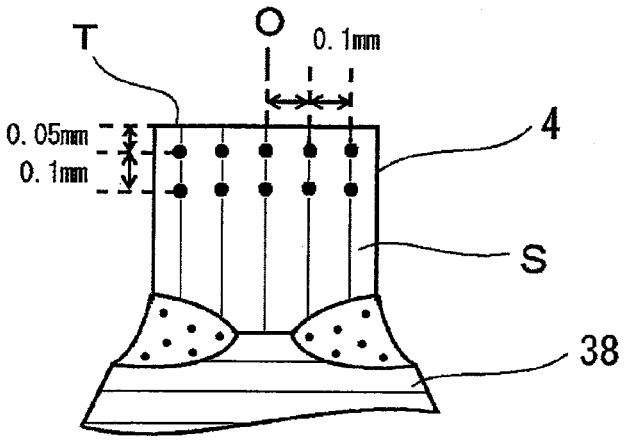
FIG. 3 is a sectional view illustrating positions on a tip where to measure Vickers hardness.

The Vickers hardnesses Has and Han of the tip 9 can be measured as follows. FIG. 3 is a sectional view illustrating positions on the tip 9 where to measure Vickers hardness. Firstly, the tip 9 is cut along a plane which includes a center axial line O. Then, on this resulting cut surface S, a position which lies on the center axial line O and 0.05 mm inwards from a front end edge T which represents a surface which is subjected to a spark discharge (a spark discharge surface) is referred to as a measuring point. Then, a plurality of points which spread at intervals of 0.1 mm in both radial directions from this point are adopted as measuring points. Similarly, a plurality of points which spread at intervals of 0.1 mm in both the radial directions in a position lying on the center axial line O and 0.15 mm inwards from the front end edge T are adopted as measuring points. Vickers hardness is measured at these measuring points in conformity to JIS Z 2244 by employing a Vickers hardness meter excluding test conditions of forcing the Vickers hardness meter into surfaces of the measuring points with a load of 1 N and holding the meter in that state for 10 seconds. Then, an arithmetic mean of the measured values is calculated, and the resulting arithmetic mean is referred to as a Vickers hardness Has. Incidentally, when dents formed as a result of the measurement lie on fused portions which are formed by the tip 9 and the center electrode 4 being fused and within an area lying 0.05 mm or less from the front end edge T which represents the spark discharge surface, the measuring results at the dents are excluded from the measured values. Vickers hardness Han is measured as follows. The other half of the tip, which is paired with one half which is used for measurement of Vickers hardness Has, is placed in an electric furnace to be subjected to the heating treatment described before. Then, the other half of the tip is removed from the furnace for measurement of Vickers hardness in a similar way to the way in which Vickers hardness Has is measured.

A tip having a hardness ratio (Has/Han) which lies within the above-described range has a fibrous crystalline structure, and fibers are oriented in the direction of the axial line O on some occasions or are oriented in a direction which is at right angles to the axial line O on other occasions. A tip from which strain is removed completely has a particulate recrystallized structure. The crystalline structure of the tip 9 can be observed with a metal microscope.

Figure 4:
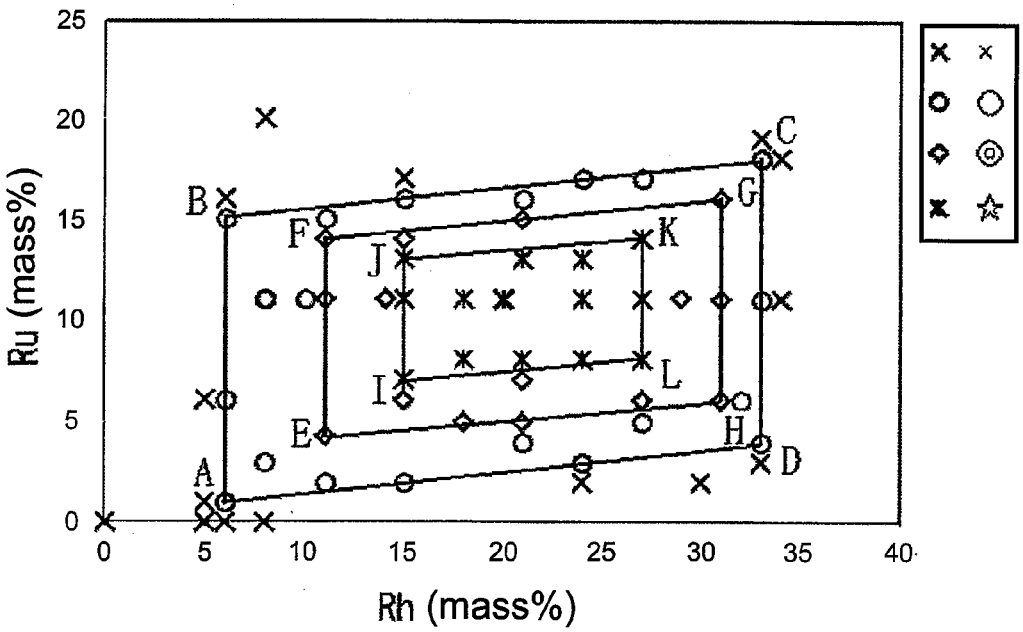
FIG. 4 is a diagram illustrating a relationship regarding mass ratio between Rh and Ru which are contained in the tip.

The tip 9 of this embodiment contains Ir, Rh and Ru in a total amount of 95 mass % or more with respect to the whole mass amount thereof, and the contents (Rh, Ru) of Rh and Ru (mass %) lie within an area which is surrounded by a line which connects point A (6, 1), point B (6, 15), point C (33, 18), point D (33, 4) and point A (6, 1) in this order (or lie on the line) (refer to FIG. 4). In the event that the tip has a certain constant degree of strain and its composition lies within the above-described range, the spark wear resistance of the spark discharge surface can be improved while maintaining the oxidation resistance, and therefore, a spark plug can be provided which is superior in durability.

It is preferable that the tip 9 of this embodiment contains Ir, Rh and Ru in a total amount of 95 mass % or more with respect to the whole mass amount thereof, and the contents (Rh, Ru) of Rh and Ru (mass %) lie within an area which is surrounded by a line which connects point E (11, 4), point F (11, 14), point G (31, 16), point H (31, 6) and the point E (11, 4) in this order (or lie on the line), and it is particularly preferable that the tip 9 of this embodiment contains Ir, Rh and Ru in a total amount of 95 mass % or more with respect to the whole mass amount thereof, and the contents (Rh, Ru) of Rh and Ru (mass %) lie within an area which is surrounded by a line which connects point I (15, 7), point J (15, 13), point K (27, 14), point L (27, 8) and the point I (15, 7) in this order (or lie on the line) (refer to FIG. 4).

The tip 9 is an Ir alloy which contains Ir as a main composition. Here, the main composition means a composition whose content is the largest in compositions contained in the tip 9. The content of Ir is in the range from 44 mass % or more to 93 mass % or less relative to the whole mass of the tip and is set as required according to the contents of Rh and Ru within a range in which the total mass of Ir, Rh and Ru ranges from 95 mass % or more to 100 mass % or less. Ir is a material having a high melting point of 2454° C. and is superior in spark wear resistance.

The tip 9 contains Rh in the above-described ratio. Containing Rh makes it difficult for Ir to be volatilized through oxidation from a surface of the tip which is exposed to the combustion atmosphere in the combustion chamber, and the oxidation resistance near the spark discharge portion of the tip is improved further than a tip which is formed of pure Ir. In the event that the content of Rh is too low, the oxidation resistance near the spark discharge portion cannot be maintained. In the event that the content of Rh is too high, the recrystallization temperature is reduced, which facilitates the removal of strain, and the content of Ir is reduced relatively. Therefore, the characteristic of Ir is prevented from working properly, resulting in inferior spark wear resistance.

The tip 9 contains Ru in the above-described ratio. In a tip which contains Rh while containing Ir as a main composition, the oxidation resistance near the spark discharge portion is improved, whereas the recrystallization temperature is reduced, which facilitates the removal of strain. However, in the event that Ru is contained in addition to Ir and Rh, not only is the yield stress of the material itself increased, but also the recrystallization temperature is increased, thereby making it possible to prevent the removal of strain. In general, in the event that Ru is added to Ir equal to or more than a predetermined quantity, as the content of Ru increases, the recrystallization temperature decreases. However, in the event that Ru is added to an Ir—Rh alloy within the above-described ratio, the recrystallization temperature is increased.

In addition, when a spark plug is used under high spark energy conditions, compared with normal spark energy conditions, the temperature of a spark discharge surface is increased to a very high temperature, which produces a large quantity of ozone, resulting in an environment where oxidation is facilitated. With a tip containing only Jr and Rh used in this environment, a layer which is rich in Rh is formed on a surface of the tip or on a grain boundary. The reason that the Rh rich layer is formed is assumed as below. Namely, although the oxidation and volatilization of Jr are accelerated by the existence of ozone or the like, since high temperature conditions like those described above configure a reducing atmosphere for Rh, Rh is not oxidized but Ir is oxidized in preference to Rh into $IrO_3$ and is then volatilized, whereby it is considered that Rh is concentrated. The melting point of Rh is low, and strain is removed completely in the portion where the Rh rich layer is formed. Thus, the thicker the Rh rich layer is formed on the surface of the tip and the grain boundary, the easier the spark wear progresses in those areas. Namely, in the tip which contains only Ir and Rh, not only are the yield stress of the material itself and the recrystallization temperature reduced, but also the oxidation and volatilization of Ir in the spark discharge surface progress, where it is found that the spark wear resistance is reduced further. On the other hand, in a tip which contains Ru in addition to Ir and Rh, even though the tip is used under the above-described environment where Ir is easily oxidized and volatilized, Ru suppresses the oxidation of Ir, whereby it is possible to suppress the formation of an Rh rich layer, thereby making it possible to suppress spark wear.

As shown in FIG. 4, containing Ru according to the content of Rh is able to not only raise the recrystallization temperature but also increase the yield stress of the material itself, as well as suppressing the formation of an Rh rich layer. When the content of Ru is too low, the above-described effect cannot be obtained, whereas the content of Ru is too high, on the contrary, the recrystallization temperature is reduced, whereby the removal of strain is facilitated, resulting in inferior spark wear resistance. Further, as the content of Rh increases, the recrystallization temperature decreases, this facilitating the formation of a thick Rh rich layer. Therefore, unless the content of Ru is increased in proportion to the content of Rh, the recrystallization temperature cannot be increased, and hence, it is not possible to suppress the formation of the Rh rich layer. In addition, in the event that the content of Rh is low, the content of Ru becomes low which is necessary to suppress the reduction in recrystallization temperature. Therefore, a low content of Rh results in a low content of Ru.

The tip of this invention should contain Ir, Rh and Ru in a total amount of 95 mass % or more with respect to the whole mass amount thereof, and therefore, the tip may contain 5 mass % or less of inevitable impurities such as Ni, Pt, Co, Mo, Re, W, Al and the like. As the inevitable impurities, for example, Cr, Si, Fe and the like can be raised. Although it is preferable to contain these impurities as little as possible, they may be contained within such a range as to achieve the solution of the problem. When assuming that the total mass of all the compositions described above is referred to as 100 parts by mass, a ratio of one of the inevitable impurities should be 0.1 or less part by mass, and a total ratio of all the impurities contained should be 0.2 or less part by mass.

The contents of the compositions contained in the tip 9 can be measured as below. Namely, firstly, the tip 9 is cut along the plane which includes the center axial line O, and the resulting cut surface is exposed. Then, on this cut surface of the tip 9, a plurality of arbitrary locations, for example, the above-described measuring points where to measure Vickers hardness are selected. Then, a composition by mass of each location is measured by performing a WDS (Wavelength Disperse X-ray Spectrometer) analysis by making use of an EPMA. Next, an arithmetic mean of the measured values of the plurality of locations measured is calculated, and the value of the arithmetic mean so calculated is referred to as the composition of the tip 9.

When provided at the front end surface of the center electrode 4 which configures a negative pole, the tip of the invention whose composition lies within the specific composition range and which has a certain constant degree of strain exhibits its effect further. When a spark is discharged, protons jump from the ground electrode 8 which is a positive pole towards the center electrode 4 which is the negative pole and collide with the surface of the tip 9 which is joined to the front end of the center electrode 4. If heavy protons collide with the surface of the tip 9, the surface of the tip 9 is deformed, whereby part of the mass of metal comes off, facilitating the spark wear thereat. On the other hand, the tip of this invention is configured such that the composition lies within the specific composition range and a certain constant degree of strain is contained, and therefore, the strain contained is not removed even by a spark discharge and hence the tip has high strength. Thus, even though heavy protons collide with the surface of the tip, the surface of the tip is made difficult to be deformed, and hence it is assumed that the spark wear can be suppressed.

The spark plug 1 of the invention has the above-described tip on at least either of the center electrode 4 and the ground electrode 8 or particularly on the center electrode 4, whereby the spark wear resistance of the spark discharge surface can be improved while maintaining the oxidation resistance thereof. Although there is imposed no limitation on other configurations, a spark plug which satisfies both a condition (1) and a condition (2) below exhibits a higher effect of improving the oxidation resistance and the spark wear resistance near the discharge portion than a spark plug which satisfies only one of the condition (1) and the condition (2).

Condition (1): in the portions of the rod-shaped portion which have the same diameter, the diameter d of the body portion which extends longest in the direction of the axial line is not more than 2.25 mm.

Condition (2): the length H in the direction of the axial line of the area where the distance h between the rod-shaped portion and the metal shell in the direction which is orthogonal to the axial line is 3 mm or less is not less than 9 mm.

In a case where the spark plug 1 satisfies the Condition (1), the thickness of the center electrode becomes thinner than that of a spark plug which does not satisfy the Condition (1), and therefore, it becomes difficult that heat generated by the spark discharge is conducted from the tip 9 to the center electrode 4 and the insulator 3, which facilitates the increase in temperature at the tip 9. Then, not only the oxidation wear of the portion lying near the discharge portion of the tip 9 but also the spark wear thereof is easily accelerated.

In a case where the spark plug 1 satisfies the Condition (2), the area where the distance h between the center electrode 4 and the metal shell 7 is short expands over a wider range in the spark plug 1 than in a spark plug which does not satisfy the Condition (2). Therefore, an electrostatic capacity which is accumulated in the center electrode 4 immediately before a spark discharge becomes large, whereby capacitive discharge energy is increased. Then, the spark discharge surface of the tip is deformed when a spark discharge takes place, whereby part of a mass of metal thereat comes off, thereby facilitating spark wear.

As has been described above, with a spark plug which satisfies both the Condition (1) and the Condition (2), the wear of a tip, in particular, is facilitated. However, according to the tip 9 of the invention, since its composition lies within the specific composition range and a certain constant degree of strain is held, there is no such situation that the remaining strain is removed completely even by a spark discharge. Thus, the tip 9 is able to have high strength. In addition, the oxidation and volatilization of Ir near the spark discharge portion progress, whereby it is possible to suppress the formation of an Rh rich layer, the effect of improving the oxidation resistance and the spark wear resistance near the discharge portion is enhanced further.

The spark plug 1 is fabricated in the following manner, for example. Firstly, the tip 9 to be joined to the center electrode 4 is fabricated as follows. Required metal compositions are blended together in accordance with their contents defined in the composition range to prepare material powder. This material powder is melted into an ingot by means of electric arc. Then, the ingot is hot forged into a rod material. Next, the forged rod material is rolled a plurality of times with a fluted roll and is then subjected to swaging as required. Then, the rod material is subjected to wire drawing in which the rod material is drawn through a die, whereby the rod material is formed into a circular rod material having a circular cross section with a fine fibrous crystalline structure. Then, the circular rod material is cut to a predetermined length, whereby a cylindrical tip is prepared. Incidentally, the shape of the tip 9 is not limited to the cylindrical shape. For example, the ingot is subjected to the wiring drawing in which the ingot is drawn through a quadrangular die so as to be formed into an angular material, and the angular material is then cut to a predetermined length, whereby an angular rod-like tip can also be prepared.

In addition to the above-described steps, the tip 9 of the invention is subjected to a heat treatment step. This is because Ru is an element having a crystalline structure which is different from that of Ir and an alloy which contains Ru and Ir, which is added to Ru, has a nature that the alloy is difficult to be formed plastically and is easy to be hardened when it is worked even though the alloy contains Rh which is said to improve the workability thereof. The heat treatment step is performed between the above-described tip forming steps or after all the forming steps have been completed. Namely, the heat treatment step is performed any time other than while the tip is formed to thereby control the degree of strain which remains in the tip. Namely, the heat treatment step is performed to control the hardness of the tip so as to lie within the range of hardness ratios (Has/Han) described above. This heat treatment step is performed by holding the tip at temperatures at which recrystallization does not occur and strain is removed to some extent for a predetermined length of time. It is preferable that the tip is heated to temperatures of, for example, 800 to 1500° C. and is held for an hour or less. The inclusion of 0 hour in the holding time does not mean that no heat treatment is performed but means that temperatures are allowed to lower without being held once a target temperature is attained. It is more preferable that the tip is heated to temperatures in the range of 900 to 1300° C. and is held for 30 seconds to 45 minutes. It is good to control a time at which the temperature is raised in the range of 2 to 30° C./min. It is more preferable that the temperature raising time is controlled in the range of 5 to 20° C./min. There is imposed no specific limitation on a heating method as long as a tip is obtained which has a harness ration which lies within the range of hardness ratios described above. The atmosphere where the tip is placed may be controlled by employing an electrical furnace, or the tip may be heated by employing a burner, or the tip may be subjected to the heat treatment a plurality of times. In addition, although some of the heat treatment temperatures described above are higher than a temperature described in claim 1 as being claimed to remove strain in the tip completely, in the event that the holding time or heating time is shortened, there is no such situation that strain is removed completely, and hence, there are fear that recrystallization is brought about.

In a case where a tip is joined to the ground electrode 8, the tip may be fabricated in a similar way to that in which the tip 9 which is joined to the center electrode 4 is fabricated. Alternatively, the tip may be fabricated by a known method.

The center electrode 4 and/or the ground electrode 8 can be fabricated, for example, by preparing a melt of an alloy having a desired composition by employing a vacuum melting furnace, wire drawing the molten alloy and adjusting the size and dimensions of the drawn alloy to a predetermined shape and predetermined dimensions. When the center electrode 4 is formed by an outer layer and a core portion which is provided so as to be embedded in a diametrically central portion of the outer layer, the central electrode 4 is formed as follows: an inner material of a Cu alloy or the like which has a higher thermal conductivity than that of an outer material which is formed of an Ni alloy into a cup-like shape is inserted into the outer material, and the resulting material is subjected to a plastic forming such as extrusion, whereby the center electrode 4 is formed in which the core portion is provided in the interior of the outer layer. As in the case of the center electrode 4, the ground electrode 8 may also be formed of an outer layer and a core portion. As this occur, as in the case with the center electrode 4, an inner material is inserted into an outer material which is formed into a cup-like shape, and after the resulting material is subjected to a plastic forming such as extrusion, the resulting material which is plastically formed into a substantially prismatic shape can be used as the ground electrode.

Next, one end portion of the ground electrode 8 is joined to an end surface of the metal shell 7 which is formed into the predetermined shape through plastic forming or the like through electric resistance welding, laser welding or the like. Following this, a Zn plating or Ni plating is applied to the metal shell 7 to which the ground electrode 8 is joined. A trivalent chromate treatment may be applied to the metal shell 7 after the Zn plating or Ni plating. In addition, the plating applied to the ground electrode may be removed.

Next, the tip 9 which is fabricated in the way described above is fused and secured to the center electrode 4 through resistance welding and/or laser welding. When the tip 9 is joined to the center electrode 4 through resistance welding, for example, resistance welding is applied with the tip 9 placed and pressed against a predetermined position of the center electrode 4. When the tip 9 is joined to the center electrode 4 through laser welding, for example, the tip 9 is placed in the predetermined position of the center electrode 4, and a laser beam is shone on to part or along the whole circumference of a contact portion where the tip 9 is in contact with the center electrode 4 from a parallel direction to a contact surface between the tip 9 and the center electrode 4. Incidentally, laser welding may be applied after the application of resistance welding. In addition, when the tip is joined to the ground electrode 8, the tip can be joined to the ground electrode in the same way as that in which the tip 9 is joined to the center electrode 4.

On the other hand, the insulator 3 is fabricated by sintering a ceramic into a predetermined shape, and the center electrode 4 to which the tip 9 is joined is inserted into the axial hole 2 in the insulator 3. Then, a compound making up the first sealer 22, a compound making up the resistor 21 and a compound making up the second sealer 23 are loaded in the axial hole 2 in this order while pre-compression is applied to them. Following this, the compounds are compressed to be heated while press fitting the metal terminal 5 into the axial hole 2 from the end portion thereof. Thus, the compounds are sintered in this way, whereby the resistor 21, the first sealer 22 and the second sealer 23 are formed. Next, the insulator 3, to which the center electrode 4 and the like are fixed, is assembled to the metal shell 7 to which the ground electrode 8 is joined. Finally, the distal end portion of the ground electrode 8 is bent towards the center electrode 4 such that the one end of the ground electrode 8 faces the front end portion of the center electrode 4, whereby the spark plug 1 is fabricated.

The spark plug 1 according to the invention is used as an ignition plug for a motor vehicle internal combustion engine such as a gasoline engine, for example. The spark plug 1 is fixed in a predetermined position by the thread portion 24 being screwed into a screw hole provided in a cylinder head (not shown) which defines combustion chambers of the internal combustion engine. Although the spark plug 1 according to the invention can be applied to any internal combustion engine, since the tip of the spark plug 1 exhibits particularly superior oxidation resistance and spark wear resistance when it is used under the high spark energy conditions, the spark plug 1 is particularly preferable for an internal combustion engine which is required to be used under high spark energy conditions.

The spark plug 1 according to the invention is not limited to the above-described embodiment and hence can be modified variously within a scope where the object of the invention can be achieved. For example, in the spark plug 1, the front end surface of the center electrode 4 and the outer circumferential surface of the distal end portion of the ground electrode 8 are disposed so as to face oppositely each other in the direction of the axial line O with the gap G defined therebetween. However, in this invention, a side surface of the center electrode and a distal end surface of the ground electrode may be disposed so as to face oppositely each other via a gap in a radial direction of the center electrode. As this occurs, a single or a plurality of ground electrodes may be provided so as to face oppositely the side surface or surfaces of the center electrode.

EXAMPLE

<Fabrication of Spark Plug Specimens>

Tips to be provided on the center electrode were fabricated as below. Material powders having predetermined compositions were blended together and were melted into an ingot by means of electric arc, and the ingot was hot forged into a rod material. Next, this rod material was rolled with a fluted roll a plurality of times, and thereafter, the forged rod material was subjected to swaging and was formed into a round rod material. Further, the round rod material was subjected to wire drawing which employed a die several times to form a round rod material of a circular cross section having a fine fibrous crystalline structure. Then, the resulting round rod material was cut to a predetermined length, whereby cylindrical tips were formed whose diameter and height were 0.8 mm and 0.6 mm, respectively.

Next, the cylindrical tips were then subjected to a heat treatment in which the cylindrical tips were held in an electric furnace at predetermined temperatures lying within the range of heat treatment temperatures of 800 to 1500° C. for predetermined lengths of time lying within the range of holding time of 0 second to 1 hour so as to control their hardness ratios (Has/Han) to lie within the range of hardness ratios defined according to the embodiment, to thereby form central electrode tips according to the embodiment having hardness ratios shown in Table 1. When the tips obtained were observed with a metal microscope, the tips had a fibrous crystalline structure.

Center electrode tips as comparison examples were fabricated as below. Material powders having predetermined compositions were blended and melted to prepare an alloy, and the resulting alloy was formed into cylindrical tips of 0.8 mm in diameter and 0.6 mm in height. These cylindrical tips were subjected to annealing as required to fabricate tips having various hardness ratios (Has/Han). Namely, electrode tips of comparison examples having Has/Han larger than 2.2 were not subjected to both the heat treatment step and annealing according to the embodiment. When the tips obtained were observed with the metal microscope, the tips had a fibrous crystalline structure. Further, the center electrode tips of comparison examples having Has/Han of from 1.5 to 2.2 were fabricated by applying the above-described heat treatment. Further, center electrode tips of comparison examples having Has/Han smaller than 1.5 were fabricated by applying annealing thereto. When the tips obtained were observed with the metal microscope, it was found that some had a fibrous crystalline structure, some had a fibrous crystalline structure and a recrystallized structure, and others had a recrystallized structure.

Tips to be joined to the ground electrode were fabricated as below. 90 mass % of Pt and 10 mass % of Ni were blended and melted, and the obtained molten material was forged and formed into a prismatic shape. The resulting prism was subjected to rolling and wire drawing and formed into a round wire. Then, the round wire was cut to a predetermined length, to thereby form cylindrical ground electrode tips of 1.0 mm in diameter and 1 mm in height.

Center electrodes and ground electrodes were fabricated as described above. Namely, a melt of an alloy having a predetermined composition was prepared, and the resulting alloy was subjected to wire drawing and the like so as to be controlled as required to the predetermined shapes and the predetermined dimensions. The diameter d of the longest body portion in the direction of the axial line of the portions of the center electrode having the same diameter was 2.3 mm.

Next, the ground electrode was joined to one end surface of the metal shell, and the ground electrode tip was joined through resistance welding to an end portion of the ground electrode to which the metal shell was not joined. In addition, the center electrode tip was joined to a front end portion of the center electrode through laser welding. On the other hand, a ceramic was sintered into the predetermined shape to fabricate an insulator. Then, the center electrode to which the tip was joined was inserted into an axial hole in the insulator. Then, compounds making up a first sealer, a resistor and a second sealer, respectively, were loaded in the axial hole in this order. Finally, a metal terminal was inserted into the axial hole and was fixed in place in the axial hole in a sealed fashion.

Next, the insulator to which the center electrode was fixed was assembled to the metal shell to which the ground electrode was joined. Finally, the distal end portion of the ground electrode was bent towards the center electrode so that the tip joined to the ground electrode and the tip joined to the front end surface of the center electrode could face each other, whereby a spark plug specimen was fabricated.

Incidentally, a thread diameter of the fabricated spark plug specimen was M14. The length H in the direction of the axial line of the area where the distance h between the rod-shaped portion and the metal shell in the direction which was at right angles to the axial line was 3.0 mm or less was 9 mm. The length t in the direction of the axial line of the projecting portion of the metal shell was 1.8 mm, and the gap G between the tips was 1.1 mm.

The hardness ratios (Has/Han) shown in Table 1 were obtained by measuring Vickers hardness (Has) and Vickers hardness (Han) and calculating a ratio thereof as follows. Vickers hardnesses (Has) of each center electrode tip were measured by firstly cutting the tip along the plane which includes the axial line, selecting a plurality of measuring points on the resulting cut surface in the above-described way, and performing measurements at these measuring points in conformity to JIS Z 2244 by employing a Vickers hardness meter excluding the adoption of a forcing load of 1 N and a holding time of 10 seconds. Then, an arithmetic mean of the measured values was calculated, and the resulting arithmetic mean was referred to as a Vickers hardness (Has). Vickers hardness (Han) was measured as follows. The tip was placed in an electric furnace to be subjected to the above-described heating treatment. Then, Vickers hardness was measured in a similar way to the way in which Vickers hardness (Has) was measured. The resulting Vickers hardness was referred to as Vickers hardness (Han).

The compositions by mass of the center electrode tips shown in Table 1 were measured by performing a WDS by employing an EPMA (JXA-8500F made by NIPPON DENSHI Co., Ltd.) (acceleration voltage: 20 kV, spot diameter: 100 μm). Firstly, the tip was cut along the plane including the center axial line, a plurality of measuring points were selected on the resulting cut surface in the above-described way, and a composition by mass was measured at each measuring point. Next, an arithmetic mean of the plurality of measured values was calculated, and the resulting mean value was referred to as the composition of the center electrode tip. Incidentally, when the measuring area which took the spot diameter into consideration existed on a fused portion which was formed as a result of the tip 9 and the center electrode 4 being fused, the result of the measurement at the measuring point was excluded.

<Bench Spark Wear Test>

The spark plug specimens fabricated were mounted in a high pressure chamber of a nitrogen atmosphere pressurized at 1.2 MPa, and spark discharge was carried out under testing conditions of ignition energy of 150 mJ, frequency of 100 Hz and discharge time of 200 hours. The discharge voltage of the capacitive discharge composition before test was measured to find 25 kV as an average of 100 spark discharges. Gaps between the tips joined to the center electrodes and the tips joined to the ground electrodes before and after test were measured, and values (G'-G) resulting from subtracting a gap G (=1.1 mm) before test from a gap G' after test was referred to as a gap increase quantity. Then, spark wear resistances of the spark plug specimens were evaluated in accordance with the following standards. The results of the evaluations are shown in Table 1.

☆: given to show that the gap increase quantity was less than 0.1 mm

◎: given to show that the gap increase quantity was 0.1 mm or more and less than 0.15 mm ○: given to show that the gap increase quantity was 0.15 mm or more and less than 0.2 mm ×: given to show that the gap increase quantity was 0.2 mm or more <Actual Durability Test>

The spark plug specimens fabricated were mounted in a test turbocharged engine and a durability test was carried out under testing conditions of ignition energy of 150 mJ, full throttle, engine rotation speed of 6000 rpm, and operating time of 150 hours. The discharge voltage of the capacitive discharge composition before test was measured to find 20 kV as an average of 100 spark discharges. Further, the temperature of a body material of the center electrode in a position 0.5 mm inwards from a front end thereof was measured with a thermocouple to find 900° C. Gaps between the tips joined to the center electrodes and the tips joined to the ground electrodes before and after test were measured, and values (G'-G) resulting from subtracting a gap G (=1.1 mm) before test from a gap G' after test was referred to as a gap increase quantity. Then, the durability of the spark plug specimens was evaluated in accordance with the following standards. The results of the evaluations are shown in Table 1. In addition, in the tips having the compositions shown in Table 1, ratios by mass of Rh and Ru of the tips whose hardness ratios (Has/Han) were 1.5 or more and 2.2 or less are shown in FIG. 4. In FIG. 4, a ratio by mass when the test result of the actual durability test was "×" is denoted by "×," a ratio by mass when the test result of the actual durability test was "○" is denoted by "○," a ratio by mass when the test result of the actual durability test was "◎" is denoted by "◇" and a ratio by mass when the test result of the actual durability test was "☆" is denoted by "*."

In Table 1,

☆ is given to show that the gap increase quantity was less than 0.06 mm,

◎ is given to show that the gap increase quantity was 0.06 mm or more and less than 0.09 mm, ○ is given to show that the gap increase quantity was 0.09 mm or more and less than 0.12 mm, and × is given to show that the gap increase quantity was 0.12 mm or more.

TABLE 1

| | Test | Center Electrode Tip Composition (mass %) | | | | | | | | | Hardness Ratio | Test Results | |
|---|---|---|---|---|---|---|---|---|---|---|---|---|---|
| | Number | Ir | Rh | Ru | Ni | Pt | Co | Mo | Re | Ir + Rh + Ru | (Has/Han) | Spark Wear Resistance | Actual Test Durability |
| Comparison Example | A-1 | 100 | | | | | | | | 100 | 1.7 | X | X |
| Comparison Example | A-2 | 95 | 5 | | | | | | | 100 | 1.9 | X | X |
| Comparison Example | A-3 | 94 | 5 | 1 | | | | | | 100 | 1.9 | ◎ | X |
| Comparison Example | A-4 | 89 | 5 | 6 | | | | | | 100 | 1.9 | ◎ | X |
| Comparison Example | A-5 | 88 | 5 | 6 | 1 | | | | | 99 | 1.9 | ◎ | X |
| Comparison Example | A-6 | 90 | 5 | | | 5 | | | | 95 | 2.2 | X | X |
| Comparison Example | A-7 | 94 | 6 | | | | | | | 100 | 2.2 | X | X |
| Comparison Example | A-8 | 93 | 6 | 1 | | | | | | 100 | 2.3 | ○ | X |
| Example | A-9 | 93 | 6 | 1 | | | | | | 100 | 2.2 | ◎ | ○ |
| Example | A-10 | 93 | 6 | 1 | | | | | | 100 | 1.5 | ◎ | ○ |
| Comparison Example | A-11 | 93 | 6 | 1 | | | | | | 100 | 1.4 | X | X |
| Example | A-12 | 88 | 6 | 6 | | | | | | 100 | 2.2 | ◎ | ○ |
| Example | A-13 | 79 | 6 | 15 | | | | | | 100 | 2.2 | ◎ | ○ |
| Comparison Example | A-14 | 78 | 6 | 16 | | | | | | 100 | 2.2 | X | X |
| Comparison Example | A-15 | 89 | 8 | | | | | | 3 | 97 | 1.9 | ◎ | X |
| Example | A-16 | 89 | 8 | 3 | | | | | | 100 | 1.5 | ◎ | ○ |
| Example | A-17 | 81 | 8 | 11 | | | | | | 100 | 2.2 | ◎ | ○ |
| Comparison Example | A-18 | 80 | 8 | 11 | 1 | | | | | 99 | 2.3 | ○ | X |
| Example | A-19 | 80 | 8 | 11 | 1 | | | | | 99 | 2.2 | ◎ | ○ |
| Example | A-20 | 80 | 8 | 11 | 1 | | | | | 99 | 1.5 | ◎ | ○ |
| Comparison Example | A-21 | 80 | 8 | 11 | 1 | | | | | 99 | 1.4 | X | X |
| Comparison Example | A-22 | 80 | 8 | 11 | 1 | | | | | 99 | 1.0 | X | X |
| Example | A-23 | 76 | 8 | 11 | 2 | | 2 | 1 | | 95 | 2.2 | ◎ | ○ |
| Comparison Example | A-24 | 71 | 8 | 20 | 1 | | | | | 99 | 1.8 | X | X |
| Example | A-25 | 79 | 10 | 11 | | | | | | 100 | 2.2 | ◎ | ○ |
| Example | A-26 | 87 | 11 | 2 | | | | | | 100 | 2.2 | ◎ | ○ |
| Example | A-27 | 85 | 11 | 4 | | | | | | 100 | 2.2 | ◎ | ◎ |
| Example | A-28 | 78 | 11 | 11 | | | | | | 100 | 1.7 | ◎ | ◎ |
| Example | A-29 | 75 | 11 | 14 | | | | | | 100 | 1.5 | ◎ | ◎ |
| Example | A-30 | 74 | 11 | 15 | | | | | | 100 | 2.2 | ◎ | ○ |
| Example | A-31 | 75 | 14 | 11 | | | | | | 100 | 2.2 | ◎ | ◎ |
| Example | A-32 | 74 | 14 | 11 | 1 | | | | | 99 | 2.2 | ◎ | ◎ |
| Example | A-33 | 83 | 15 | 2 | | | | | | 100 | 2.2 | ◎ | ○ |
| Example | A-34 | 79 | 15 | 6 | | | | | | 100 | 2.1 | ◎ | ◎ |
| Comparison Example | A-35 | 78 | 15 | 7 | | | | | | 100 | 2.3 | ○ | X |
| Example | A-36 | 78 | 15 | 7 | | | | | | 100 | 2.2 | ◎ | ☆ |
| Example | A-37 | 78 | 15 | 7 | | | | | | 100 | 1.5 | ◎ | ☆ |
| Comparison Example | A-38 | 78 | 15 | 7 | | | | | | 100 | 1.4 | X | X |
| Example | A-39 | 74 | 15 | 11 | | | | | | 100 | 2.2 | ◎ | ☆ |
| Example | A-40 | 72 | 15 | 13 | | | | | | 100 | 2.2 | ◎ | ☆ |
| Example | A-41 | 71 | 15 | 14 | | | | | | 100 | 2.2 | ◎ | ◎ |
| Example | A-42 | 69 | 15 | 16 | | | | | | 100 | 1.7 | ◎ | ○ |
| Comparison Example | A-43 | 68 | 15 | 17 | | | | | | 100 | 1.8 | X | X |
| Example | A-44 | 77 | 18 | 5 | | | | | | 100 | 2.0 | ◎ | ◎ |
| Example | A-45 | 74 | 18 | 8 | | | | | | 100 | 2.2 | ◎ | ☆ |
| Example | A-46 | 71 | 18 | 11 | | | | | | 100 | 1.8 | ◎ | ☆ |
| Comparison Example | A-47 | 79.5 | 20 | 0.5 | | | | | | 100 | 1.8 | X | X |
| Comparison Example | A-48 | 69 | 20 | 11 | | | | | | 100 | 2.3 | ○ | X |
| Example | A-49 | 69 | 20 | 11 | | | | | | 100 | 2.2 | ◎ | ☆ |
| Example | A-50 | 69 | 20 | 11 | | | | | | 100 | 1.5 | ◎ | ☆ |
| Comparison Example | A-51 | 69 | 20 | 11 | | | | | | 100 | 1.4 | X | X |
| Comparison Example | A-52 | 69 | 20 | 11 | | | | | | 100 | 1.0 | X | X |
| Example | A-53 | 68 | 20 | 11 | 1 | | | | | 99 | 2.2 | ◎ | ☆ |
| Example | A-54 | 68 | 20 | 11 | | | 1 | | | 99 | 2.2 | ◎ | ☆ |
| Example | A-55 | 67 | 20 | 11 | 1 | | | 1 | | 98 | 2.2 | ◎ | ☆ |
| Example | A-56 | 66 | 20 | 11 | 1 | | | 2 | | 97 | 2.2 | ◎ | ☆ |
| Example | A-57 | 64 | 20 | 11 | 1.5 | | | 3.5 | | 95 | 2.2 | ◎ | ☆ |
| Example | A-58 | 64 | 20 | 11 | 1.5 | | | 3.5 | | 95 | 1.5 | ◎ | ☆ |
| Example | A-59 | 64 | 20 | 11 | 1.5 | | | | 3.5 | 95 | 2.2 | ◎ | ☆ |
| Comparison Example | A-60 | 64 | 20 | 11 | 1.5 | | | 4 | | 94.5 | 1.4 | X | X |
| Example | A-61 | 75 | 21 | 4 | | | | | | 100 | 2.1 | ◎ | ○ |

TABLE 1-continued

| | Test | Center Electrode Tip Composition (mass %) | | | | | | | | | Hardness Ratio | Test Results | |
|---|---|---|---|---|---|---|---|---|---|---|---|---|---|
| | | | | | | | | | | | | Spark Wear | Actual Test |
| | Number | Ir | Rh | Ru | Ni | Pt | Co | Mo | Re | Ir + Rh + Ru | (Has/Han) | Resistance | Durability |
| Example | A-62 | 74 | 21 | 5 | | | | | | 100 | 2.2 | ◎ | ◎ |
| Example | A-63 | 72 | 21 | 7 | | | | | | 100 | 1.7 | ◎ | ◎ |
| Example | A-64 | 71 | 21 | 8 | | | | | | 100 | 2.2 | ◎ | ☆ |
| Example | A-65 | 66 | 21 | 13 | | | | | | 100 | 2.2 | ◎ | ☆ |
| Example | A-66 | 64 | 21 | 15 | | | | | | 100 | 2.2 | ◎ | ◎ |
| Example | A-67 | 63 | 21 | 16 | | | | | | 100 | 2.1 | ◎ | ○ |
| Comparison Example | A-68 | 74 | 24 | 2 | | | | | | 100 | 1.5 | X | X |
| Comparison Example | A-69 | 73 | 24 | 3 | | | | | | 100 | 2.3 | ○ | X |
| Example | A-70 | 73 | 24 | 3 | | | | | | 100 | 2.2 | ◎ | ○ |
| Example | A-71 | 73 | 24 | 3 | | | | | | 100 | 1.5 | ◎ | ○ |
| Comparison Example | A-72 | 73 | 24 | 3 | | | | | | 100 | 1.4 | X | X |
| Example | A-73 | 68 | 24 | 8 | | | | | | 100 | 2.2 | ◎ | ☆ |
| Example | A-74 | 65 | 24 | 11 | | | | | | 100 | 1.5 | ◎ | ☆ |
| Example | A-75 | 63 | 24 | 13 | | | | | | 100 | 2.2 | ◎ | ☆ |
| Example | A-76 | 59 | 24 | 17 | | | | | | 100 | 2.2 | ◎ | ○ |
| Example | A-77 | 68 | 27 | 5 | | | | | | 100 | 2.2 | ◎ | ○ |
| Example | A-78 | 67 | 27 | 6 | | | | | | 100 | 1.5 | ◎ | ◎ |
| Example | A-79 | 65 | 27 | 8 | | | | | | 100 | 2.2 | ◎ | ☆ |
| Example | A-80 | 62 | 27 | 11 | | | | | | 100 | 2.2 | ◎ | ☆ |
| Comparison Example | A-81 | 59 | 27 | 14 | | | | | | 100 | 2.3 | ○ | X |
| Example | A-82 | 59 | 27 | 14 | | | | | | 100 | 2.2 | ◎ | ☆ |
| Example | A-83 | 59 | 27 | 14 | | | | | | 100 | 1.5 | ◎ | ☆ |
| Comparison Example | A-84 | 59 | 27 | 14 | | | | | | 100 | 1.4 | X | X |
| Example | A-85 | 56 | 27 | 17 | | | | | | 100 | 2.2 | ◎ | ○ |
| Example | A-86 | 60 | 29 | 11 | | | | | | 100 | 1.6 | ◎ | ◎ |
| Comparison Example | A-87 | 68 | 30 | 2 | | | | | | 100 | 1.5 | X | X |
| Example | A-88 | 63 | 31 | 6 | | | | | | 100 | 2.2 | ◎ | ◎ |
| Example | A-89 | 58 | 31 | 11 | | | | | | 100 | 2.2 | ◎ | ◎ |
| Example | A-90 | 53 | 31 | 16 | | | | | | 100 | 2.2 | ◎ | ◎ |
| Example | A-91 | 62 | 32 | 6 | | | | | | 100 | 2.2 | ◎ | ○ |
| Comparison Example | A-92 | 64 | 33 | 3 | | | | | | 100 | 1.9 | X | X |
| Example | A-93 | 63 | 33 | 4 | | | | | | 100 | 2.2 | ◎ | ○ |
| Example | A-94 | 56 | 33 | 11 | | | | | | 100 | 1.5 | ◎ | ○ |
| Comparison Example | A-95 | 49 | 33 | 18 | | | | | | 100 | 2.3 | ○ | X |
| Example | A-96 | 49 | 33 | 18 | | | | | | 100 | 2.2 | ◎ | ○ |
| Example | A-97 | 49 | 33 | 18 | | | | | | 100 | 1.5 | ◎ | ○ |
| Comparison Example | A-98 | 49 | 33 | 18 | | | | | | 100 | 1.4 | X | X |
| Comparison Example | A-99 | 48 | 33 | 19 | | | | | | 100 | 1.7 | X | X |
| Comparison Example | A-100 | 55 | 34 | 11 | | | | | | 100 | 1.8 | ○ | X |
| Comparison Example | A-101 | 48 | 34 | 18 | | | | | | 100 | 2.0 | ○ | X |

<Evaluation Test by Hardness Ratio (Has/Han)>

As to the specific spark plug test specimens in Table 1, the hardness ratios (Has/Han) were changed within the range of 1.4 to 2.3 by controlling temperature and time in the heat treatment step in the tip fabrication process. Excluding this, the spark plug specimens were fabricated using a similar method to that by which the spark plug specimens described before were fabricated. Then, a similar actual durability test to that described above was carried out, and the durability of the spark plug specimens was evaluated in accordance with the following standards. The results of the evaluation are shown in Table 2.

In Table 2,

☆ is given to show that the gap increase quantity was less than 0.06 mm,

◎ is given to show that the gap increase quantity was 0.06 mm or more and less than 0.09 mm, ○ is given to show that the gap increase quantity was 0.09 mm or more and less than 0.12 mm, and × is given to show that the gap increase quantity was 0.12 mm or more.

TABLE 2

| | Test | Hardness ratio | Center Electrode Tip Composition (Test Number) | | | | | | | | |
|---|---|---|---|---|---|---|---|---|---|---|---|
| | No. | (Has/Han) | A-24 | A-47 | A-13 | A-27 | A-40 | A-53 | A-79 | A-90 | A-93 |
| Comparison Example | B-1 | 1.4 | X | X | X | X | X | X | X | X | X |
| Example | B-2 | 1.5 | X | X | ○ | ◎ | ☆ | ☆ | ☆ | ◎ | ○ |
| Example | B-3 | 1.7 | X | X | ○ | ◎ | ☆ | ☆ | ☆ | ◎ | ○ |
| Example | B-4 | 1.9 | X | X | ○ | ◎ | ☆ | ☆ | ☆ | ◎ | ○ |
| Example | B-5 | 2.2 | X | X | ○ | ◎ | ☆ | ☆ | ☆ | ◎ | ○ |
| Comparison Example | B-6 | 2.3 | X | X | X | X | X | X | X | X | X |

<Evaluation Test of Spark Plug Specimens by Configuration>

Spark plug specimens were fabricated by a similar method to that by which the spark plug specimens described before were fabricated by employing the center electrode tips denoted by the test numbers A-18 and A-19 which have the same composition and different harness ratios except that the diameter d, the distance h and the length H in the direction of the axial line of the center electrode were changed. A similar actual durability test to that done before was carried out using these spark plug specimens. Then, volumes of the tips joined to the center electrodes were measured before and after the actual durability test with a CT scanner (TOSCANER-32250 μHD made by TOSHIBA Co., Ltd.), and reduced volumes were referred to as wear volumes. A value resulting from dividing the wear volume of Test Number A-19 by the wear volume of Test Number A-18 was calculated as a wear volume ratio, and evaluations were made in accordance with the following standards. The results of the evaluations are shown in Table 3. Incidentally, in Table 3, the distance h (=3.1 mm) in Test Number C-3 is a minimum distance between the rod-shaped portion and the metal shell.

In Table 3,

◎ is given to show that the wear volume was 0.6 or less,

○ is given to show that the wear volume was more than 0.6 and 0.8 or less, and

Δ is given to show that the wear volume is 0.8 or more.

TABLE 3

| Test Number | Thread Diameter | Center Electrode Diameter d (mm) | Distance h (mm) | Length H (mm) | Evaluation Result |
|---|---|---|---|---|---|
| C-1 | M14 | 2.60 | 2.9 | 9 | Δ |
| C-2 | M14 | 2.30 | 3.0 | 9 | Δ |
| C-3 | M14 | 2.25 | 3.1 | 9 | Δ |
| C-4 | M14 | 2.25 | 3.0 | 8.5 | Δ |
| C-5 | M10 | 1.70 | 2.2 | 8.5 | Δ |
| C-6 | M14 | 2.25 | 3.0 | 9 | ○ |
| C-7 | M14 | 2.25 | 2.7 | 9 | ○ |
| C-8 | M12 | 2.25 | 2.5 | 9 | ○ |
| C-9 | M12 | 1.70 | 2.8 | 9 | ○ |
| C-10 | M12 | 1.50 | 2.9 | 9 | ○ |
| C-11 | M12 | 1.50 | 2.9 | 13 | ○ |
| C-12 | M10 | 2.25 | 1.9 | 9 | ○ |
| C-13 | M10 | 1.50 | 2.3 | 9 | ○ |
| C-14 | M14 | 2.25 | 3.0 | 9 | ◎ |
| C-15 | M12 | 2.25 | 2.7 | 9 | ◎ |
| C-16 | M12 | 1.70 | 2.8 | 9 | ◎ |
| C-17 | M12 | 1.50 | 2.9 | 9 | ◎ |
| C-18 | M12 | 1.50 | 2.9 | 13 | ◎ |
| C-19 | M10 | 2.25 | 1.9 | 9 | ◎ |
| C-20 | M10 | 1.50 | 2.3 | 9 | ◎ |

The spark plugs in which the tips included in the scope of the invention were joined to the center electrodes exhibited good spark wear resistances and actual test durabilities as shown in Table 1. In particular, in the evaluation of spark wear resistance, although it is generally considered that tips formed of materials having high melting points and thermal conductivities are advantages with respect to spark wear resistance, the spark plugs including the tips lying within the scope of the invention were better than the spark plug (A-1) which included Ir having the highest melting point and thermal conductivity in the tip. Consequently, it has been shown that according to the invention, it is possible to provide the spark plug which has the superior durability by suppressing the oxidation wear and spark wear of the spark discharge surface of the tip.

On the other hand, the spark plugs in which the tips lying out of the scope of the invention were joined to the center electrodes were evaluated as being inferior with respect to both spark wear resistance and actual test durability or as being superior with respect to spark wear resistance but inferior with respect to actual test durability as shown in Table 1. Consequently, it has been shown that the spark plugs in which the tips lying out of the scope of the invention were joined to the center electrodes were inferior with respect to durability due to the spark plugs being inferior with respect to oxidation resistance and/or spark wear resistance.

It has been shown that with the diameter d of the center electrode being small or particularly 2.25 mm or less and the length H in the direction of the axial line of the area where the distance h is 3 mm or less being 9 mm or more, the wear volume ratios become small and the wear resistance improvement effect becomes higher as shown in Table 3.

What is claimed is:

1. A spark plug comprising:

an insulator that has an axial hole extending in a direction of an axial line;

a center electrode disposed at a front end side of the axial hole;

a metal terminal disposed at a rear end side of the axial hole;

a connecting portion which is electrically connected to the center electrode and the metal terminal within the axial hole;

a metal shell accommodating the insulator therein; and a ground electrode, a first end portion of which is joined to a front end portion of the metal shell, and a second end portion of which is disposed apart from the center electrode so as to define a gap therebetween, wherein at least either of the center electrode and the ground electrode has a tip which defines the gap, wherein the tip contains Ir, Rh and Ru in a total amount of 95 mass % or more with respect to the whole mass amount thereof, and the contents (Rh, Ru) of Rh and Ru (mass %) lie within an area that is surrounded by a line connecting point A (6, 1), point B (6, 15), point C (33, 18), point D (33, 4) and the point A (6, 1) in this order or lie on the line, wherein the tip satisfies a relation of $1.5 \leq Has/Han \leq 2.2$, wherein Has is a Vickers hardness measured at a cut surface of the tip which results when the tip is cut along a plane which includes the axial line, and Han is a Vickers hardness measured at the cut surface after the tip is placed in a furnace of an Ar atmosphere to be heated and held at 1300° C. for 10 hours and is then cooled down, and wherein the tip is cooled down by stopping the heating of the tip with Ar caused to flow at a rate of 2 liter/min and keeping Ar flowing into the furnace at the same rate even after the heating of the tip has been stopped.

2. The spark plug according to claim 1, wherein the contents (Rh, Ru) of Rh and Ru (mass %) lie within an area which is surrounded by a line which connects point E (11,4), point F (11, 14), point G (31, 16), point H (31, 6) and the point E (11, 4) in this order or lie on the line.

3. The spark plug according to claim 1, wherein the contents (Rh, Ru) of Rh and Ru (mass %) lie within an area which is surrounded by a line which connects point I (15, 7), point J (15, 13), point K (27, 14), point L (27, 8) and the point I (15, 7) in this order or lie on the line.

4. The spark plug according to claim 1, wherein the center electrode has a rear end portion which is in contact with the connecting portion and a rod-shaped portion which extends from the rear end portion towards a front end side, wherein in portions of the rod-shaped portion having the same diameter, a diameter of a body portion having the longest length in the direction of the axial line is not more than 2.25 mm, and wherein a length in the direction of the axial line of an area where a distance between the rod-shaped portion and the metal shell in a direction orthogonal to the axial line is 3 mm or less is not less than 9 mm.

* * * * *